US008067915B2

(12) United States Patent
Hooker et al.

(10) Patent No.: US 8,067,915 B2
(45) Date of Patent: Nov. 29, 2011

(54) ELECTRONIC CONTROL CIRCUIT FOR A POWERED APPLIANCE DRAWER

(75) Inventors: John K. Hooker, Louisville, KY (US); Konstantin Grigoryan, Louisville, KY (US); Arti Shah, Maharashtra (IN)

(73) Assignee: General Electric Company, Schenectady, NY (US)

( * ) Notice: Subject to any disclaimer, the term of this patent is extended or adjusted under 35 U.S.C. 154(b) by 451 days.

(21) Appl. No.: 12/347,373

(22) Filed: Dec. 31, 2008

(65) Prior Publication Data

US 2010/0168920 A1 Jul. 1, 2010

(51) Int. Cl.
*H02H 7/08* (2006.01)
*G05D 3/12* (2006.01)

(52) U.S. Cl. ..... 318/466; 318/286; 49/26; 49/28; 62/153; 62/162; 312/319.8; 312/330.1; 312/334.1

(58) Field of Classification Search ..... 49/28, 26; 312/319.8, 330.1, 334.1; 62/153, 162; 318/466, 318/286, 18
See application file for complete search history.

(56) References Cited

U.S. PATENT DOCUMENTS 2,895,781 A 7/1959 Latter et al.
3,028,209 A * 4/1962 Hinkel et al. ..... 312/319.7
4,305,625 A * 12/1981 Gutner et al. ..... 384/19
5,087,107 A 2/1992 Fumanelli
5,101,714 A 4/1992 Grandi
5,120,118 A * 6/1992 Rankin ..... 312/402
5,564,767 A 10/1996 Strepek
5,661,978 A * 9/1997 Holmes et al. ..... 62/3.6
6,533,375 B2 3/2003 Fulterer et al.
6,571,808 B2 6/2003 Todd
6,732,552 B2 5/2004 Kim et al.
7,583,040 B2 * 9/2009 Claudel et al. ..... 318/466
7,750,591 B2 * 7/2010 Wang et al. ..... 318/480
7,823,993 B2 * 11/2010 Ostrowski ..... 312/333
2001/0013745 A1 * 8/2001 Fulterer et al. ..... 312/319.5
2001/0054257 A1 * 12/2001 Wygle et al. ..... 49/349
2006/0013677 A1 1/2006 Oh et al.
2007/0262686 A1 * 11/2007 Ji ..... 312/402
2008/0302114 A1 * 12/2008 Kelly et al. ..... 62/170

OTHER PUBLICATIONS

U.S. Appl. No. 11/962,074, filed Dec. 20, 2007.

* cited by examiner

*Primary Examiner* — Rita Leykin
(74) *Attorney, Agent, or Firm* — Fay Sharpe LLP

(57) ABSTRACT

An appliance, such as a refrigerator, includes a drawer mounted within a cabinet for movement between an opened position and a closed position. A driving mechanism, including an electric motor connects to the drawer for driving the drawer between the opened position and the closed position. A control circuit connected to the electric motor and the transmission assembly of the driving mechanism commands the transmission assembly to connect or disconnect the electric motor and the drawer, and further commands the electric motor to drive the drawer to one of the opened position and the closed position when the electric motor is connected to the drawer. The control circuit also senses obstructions and adjusts the movement of the drawer accordingly.

30 Claims, 15 Drawing Sheets

ELECTRONIC CONTROL CIRCUIT FOR A POWERED APPLIANCE DRAWER

BACKGROUND

The present disclosure generally relates to appliances, including refrigerators, and more particularly relates to an electronic control circuit for a powered appliance drawer.

A popular refrigerator configuration includes a bottom mounted freezer drawer that slides in and out for easy access. However, with the drawer being at the bottom of the refrigerator cabinet, bending and a significant pulling force are required for opening the drawer. This may be difficult for some people, such as the elderly. In addition, the drawer typically includes a gasket for sealing thereof when in its closed position. The sealing by the gasket causes an increased force to be needed for opening the drawer to overcome sealing of the gasket. Still further, these drawers, which are sometimes heavy, may not fully close, which may lead to energy loss and overrunning of the refrigerator's compressor if left unchecked.

Others have sometimes attempted to overcome the foregoing problems. For example, some freezer drawers employ a pivoting action to overcome the sealing of the gasket to allow the drawer to be more easily opened. Some freezer drawers are moved over a slight incline upward as the drawer is opened such that the drawer is biased to its fully closed position by gravitational force to facilitate full closure of the freezer drawer. Of course, such an incline, even when slight, causes yet further force to be applied to the drawer when opening it.

SUMMARY

According to one aspect, a control system for a powered refrigerator drawer is provided. More particularly, in accordance with this aspect, the powered refrigerator drawer includes a drawer mounted within a refrigerator for movement between a closed position and an opened position. A driving mechanism is connected to the drawer for driving the drawer between the closed position and the opened position. The driving mechanism has an engaged state wherein the drawer is power driven by the driving mechanism between the closed and the opened positions and a disengaged state wherein the drawer is manually movable between the closed and the opened positions.

According to a further aspect, an electronic control for a powered appliance drawer is provided. More particularly, in accordance with this aspect, the control system incorporates receiving input from switches or buttons triggered by a user which controls the extension and retraction of the drawer from the appliance.

A control circuit commands the transmission assembly to connect the motor to the drawer when sensed that the drawer is being manually moved and commands the motor to drive the drawer. The control circuit stops powered driving of the drawer when the drawer reaches one of a fully opened position, a fully closed position, and an obstruction in a path of travel between the fully opened position and the fully closed position.

According to another aspect, an electronic control is provided. More particularly, in accordance with this aspect, the electronics employ a sensor that detects and reacts to obstructions in the path of the drawer. As such, the open, close, and pause is controlled without human interaction or input from a user or interface.

According to another aspect, a powered appliance drawer control circuit comprising a sensor located on an exterior surface of the appliance; at least one command signal generated after interaction with a user; a controller which converts the user initiated command signal into an instruction; a solenoid activator connected to a servo and initiated by the instruction; and an appliance drawer which moves in a lateral direction based on the motion of the servo.

According to a further aspect, a system is presented for opening and closing a refrigerator drawer comprising receiving a user request from one of a user input or from a user applied force placed upon the drawer to open a closed drawer or to close an open drawer; detecting through use of a sensor whether a drawer is currently in an open or a closed position; sending the user request to open or closed a drawer, along with the current position of the drawer to a controller using a command signal; signaling that the open drawer is to be closed or the closed drawer is to be opened through use of a command signal emitted from the controller and sent to a solenoid activator which activates a servo; activating the servo to perform the mechanical work to open or close a drawer and ceasing the servo motion when the drawer is completely in the open or the closed position.

DETAILED DESCRIPTION

Figure 1:
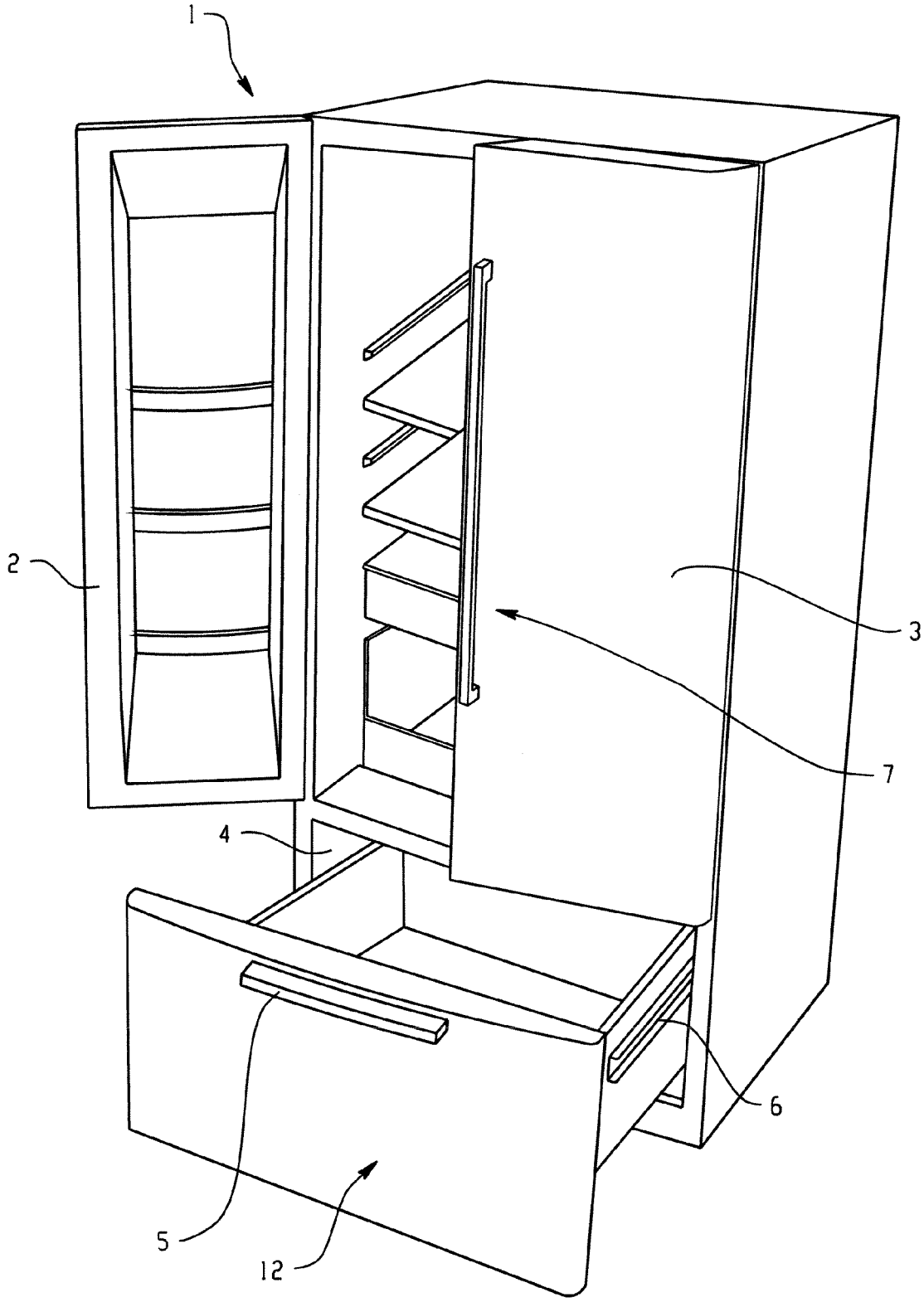
FIG. 1 is a perspective view of a refrigerator having a powered drawer.

With reference to FIG. 1, an appliance 1 having a powered drawer 12 is shown. In the embodiment illustrated in FIG. 1, the appliance 1 is a refrigerator, but it is to be appreciated that the appliance could be any other type of appliance in which a drawer, such as drawer 12, is provided. The drawer 12 may be opened manually by applying a pulling force to a handle 5, or automatically by power via the current application. When mounted within a refrigerator, the drawer 12 can be referred to as a powered refrigerator drawer. The illustrated refrigerator 1 is a bottom mount refrigerator in that it has a freezer compartment 4 disposed at a bottom of the refrigerator below a fresh food storage compartment. More particularly, the refrigerator 1 includes a refrigerator cabinet or housing which defines the fresh food refrigerated storage compartment and the freezer compartment 4 (i.e., the refrigerated component is housed by the cabinet above the refrigerator compartment 4). The drawer 12 is mounted within the refrigerator 1, and in the freezer storage compartment 4, for movement between a closed position and an opened position (the position illustrated in FIG. 1). In this configuration, the drawer 12 is mounted on rails 6 on opposite sides of the drawer. This may be referred to as a bottom mount freezer drawer. Doors 2, 3 can be disposed in side-by-side relation over the fresh food storage compartment for providing access thereto and may be opened manually by applying pulling force to a handle 7. In addition, the drawer 12 can include a handle for facilitating manual movement of the drawer 12 between its opened and closed positions.

Figure 2:
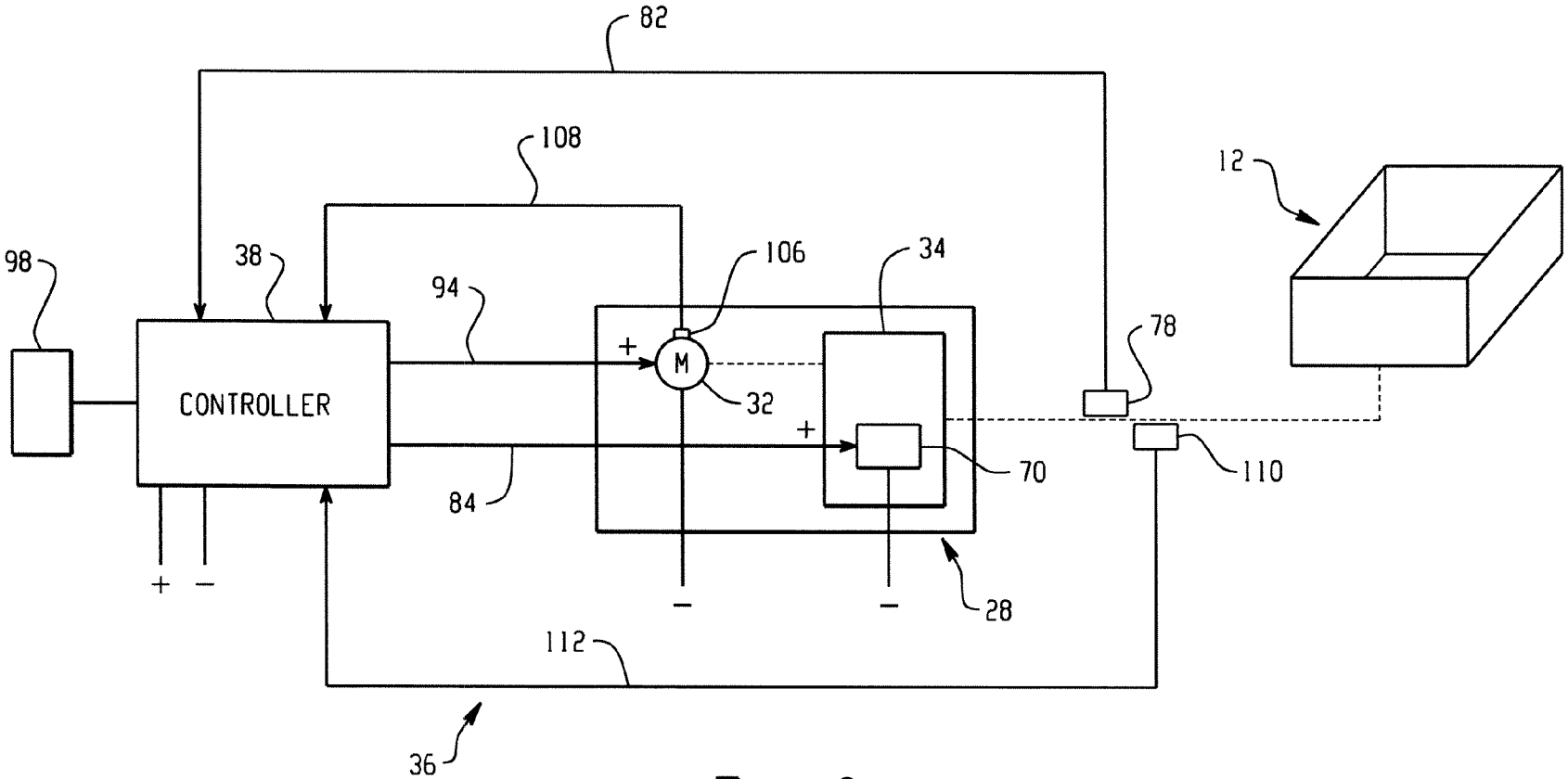
FIG. 2 illustrates how the drawer connects to the circuitry in the control system.

With reference to FIG. 2, a driving mechanism 28 shown schematically connected to the drawer 12 can be provided for powered driving of the drawer 12 between its open and closed positions (i.e., the driving mechanism drives the drawer 12 to its open position, its closed position or any intermediate position). The driving mechanism employs a prime mover, such as an electric motor, to reduce the effort required to open and close the drawer, an effort that is otherwise substantial. The driving mechanism can have an engaged state wherein the drawer 12 is power driven by the driving mechanism between the opened and closed positions and a disengaged state wherein the drawer 12 is manually movable between the opened and closed positions.

In the illustrated embodiment, the driving mechanism 28 includes a motor 32, such as an electric motor, and a transmission assembly 34 that selectively connects the electric motor 32 to the drawer. This serves to move the drawer in and out, or to open and closed positions by converting rotational power from the motor 32 to linear movement of the powered drawer 12. Particularly, the transmission assembly 34 converts rotational power from the motor 32 to linear movement of the drawer 12 when the driving mechanism 28 is in its engaged state. As will be described below, operation of the motor 32 in a first rotational direction with the driving mechanism 28 in its engaged state causes the drawer 12 to move in a first linear direction, such as toward its open position, and operation of the motor 32 in a second, opposite rotational direction with the driving mechanism 28 in its engaged state causes the drawer 12 to move in a second, opposite linear direction, such as toward its closed position. A control circuit 36, and particularly a controller 38 of the control circuit, is connected to and controlled by a solenoid 70 to the motor 32 and the transmission assembly 34. The control circuit 36, and again particularly the controller 38, sends commands to 84 the transmission assembly 34 to connect or disconnect the electric motor 32 and the drawer 12, and further sends commands 94 to the electric motor 32 to drive the drawer 12 to or toward either the opened position or the closed position when the motor 32 is connected to the drawer 12.

The control circuit 36 via the controller 38 can sense when the drawer 12 is being manually moved towards its closed position or its open position. More particularly, an encoder 78 can be provided in conjunction with the drive assembly 28 for sensing when the drawer 12 is being manually moved 38. Upon receiving the signal 82 indicating manual movement of the drawer 12 and the control circuit 36, and particularly the controller 38, can command the motor 32 to drive the drawer 12. In this manner, the control circuit 36 and the controller 38 command the driving mechanism 28 to power the drawer 12 to one of its closed and open positions.

The control circuit 36 can additionally include a sensor 106 for determining that the drawer 12 has encountered an obstruction preventing the drawer 12 from being power driven to its fully opened or closed positions. In one exemplary embodiment, the sensor 106 is a current sensor on the motor 32 that, when used in conjunction with the encoder 78, can indicate via signal 108 that a current level above a predetermined threshold is being sent to the motor 32 without expected resultant movement of the drawer 12 as measured by the encoder 78. Under such a condition, the control circuit 36 via the controller 38 can command the driving mechanism 28 to cease power driving the drawer 12 (e.g., when the drawer 12 encounters an obstruction that prevents it from reaching its open and/or closed position). Moreover, if desired, a visual and/or audio alarm can be provided through the user interface 98 indicating that an obstruction has been sensed and optionally requiring resetting before further power driving of the drawer 12 is allowed.

Another sensor 110 can be disposed in association with the drawer 12 for indicating that the drawer is not in its fully closed position (i.e., the sensor 110 can simply indicate that the drawer 12 is opened). The sensor 110 can communicate with the controller through signal 112; thus, signal 112 indicates the state of the drawer 12 (i.e., closed or opened). The controller 38 can use the signal 112 to indicate through a user interface 98 that the drawer 12 is opened or not fully closed, or alternatively can power drive the drawer 12 to its fully closed position via the driving mechanism 28 (i.e., an automatic close feature).

Figure 3:
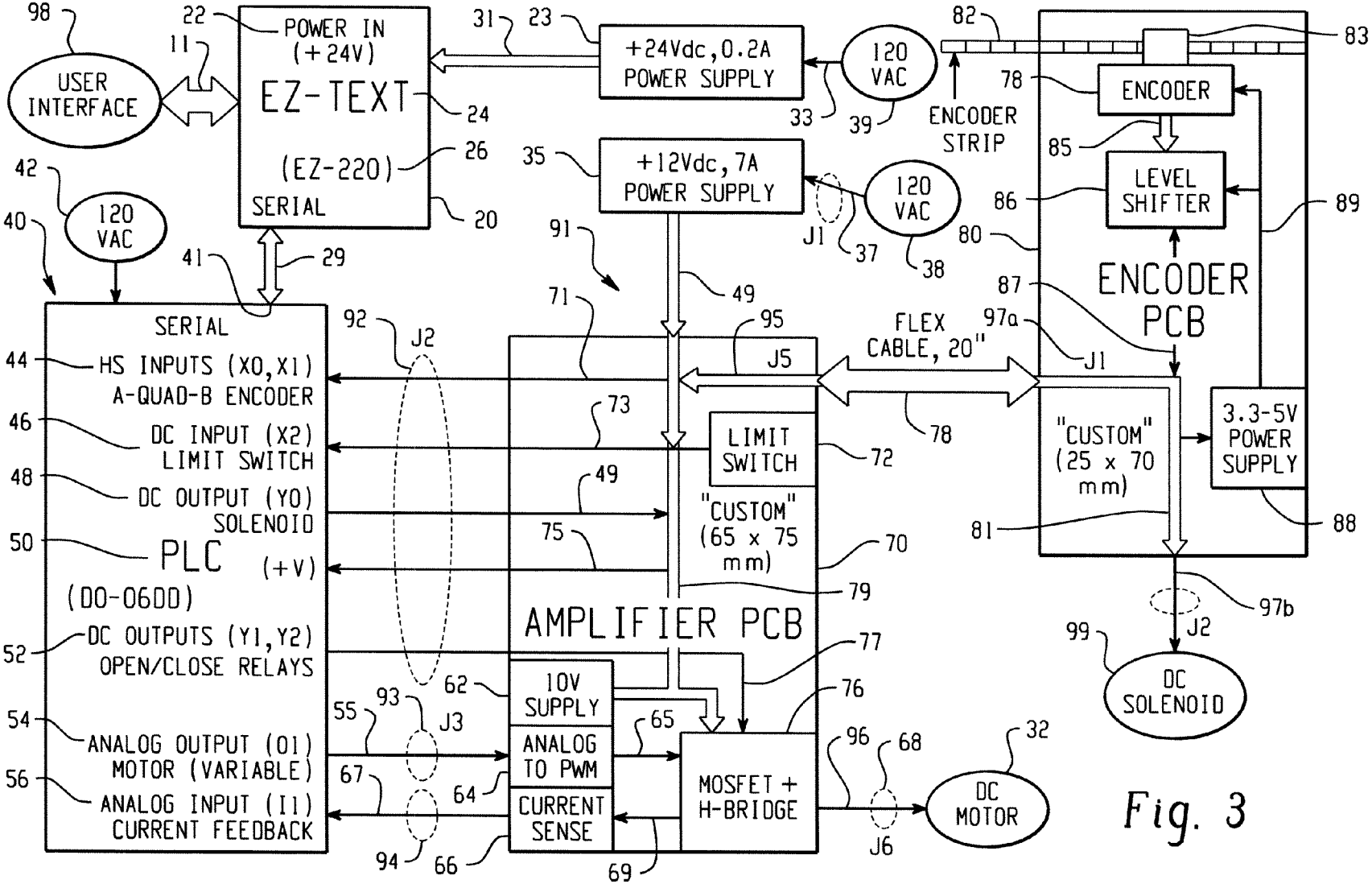
FIG. 3 illustrates the interconnection between the power supply and the electrical components.

With reference to FIG. 3, the interaction of the solenoids and the power supply are presented. User interface 98, such as but not limited to a button on the exterior or interior of the refrigerator unit 10, or a remote control unit, interfaces at 11 either in a wired or wireless manner with an input unit 20. The unit may also present a text output 24 or other such indicator to identify the state of the drawer. This may be a unit such as, but not limited to EZ-220 system 26. The input 98 can be powered 22 by a power input 31 to a 24 volt DC and 0.2 amp power supply which converts via a rectifier 23 a connected (at 33) and attached 120 volt AC power supply 39 (e.g., from a wall outlet).

The unit 20 is also connected by an interface 20 via a serial port 29 to another serial port 41 on a PLC (D0-06DD) unit 40, hereinafter referred to as the PLC unit 40. The unit is powered by a 120 volt AC system 42. The PLC 40 may include a high speed (HS) Input 44 comprised of A-quad-B encoder, which is connected at 71 to an amplifier 70. The PLC 40 also includes a DC input limit switch 46 which is connected at 73 to the amplifier 70. The PLC 40 also includes a DC Output 48 solenoid which is also connected at 49 to the amplifier 70. The unit 40 also receives a positive voltage 75 from the amplifier 50. The PLC 40 may also include a DC output 52 for the open and close relays which is connected at 77 to the amplifier 70. Each connection passes through a J2 92. An analog output 54 for the variable speed motor is connected at 55 to the amplifier 70 in an analog to PWM 64 such that the connection passes through a J3 93. An analog input 56 for current feedback is also connected 67 to the amplifier 70 and receives a signal from the current sense portion 66 of the amplifier 70 and the connection passes through a separate J3 94.

The amplifier 70 includes a MOSFET H-bridge 76 which outputs at 69 to the current sense 66 and also receives a signal 65 from the analog to PWM 64. The MOSFET is also connected at 69 to a DC motor such as motor 32 wherein the connection 96 passes through a J6 68. The MOSFET bridge 76 and a 10 volt power supply 62 are both connected to the amplifier 70 by means of the central cable 79 which is also attached to the leads coming from and going to 71, 73, 75 to the PLC 40. Also connected is a limit switch 72 and a J5 95. This connection 79 is also connected at 91 to a 12 volt DC and 7 amp power supply 35 which rectifies a 120 volt AC 38 via a connection 37.

The amplifier 70 by way of the J5 95 is connected by means such as but not limited to a flex cable 78, to an encoder PB 80 at a point J1 97*a*. The encoder comprises an encoder strip 82 attached 83 to the encoder 78 which is a ached at 85 to a level shifter 86 and attached to the J1 975*a* via a connection 87. The J1 is attached at a connection 81 to a DC solenoid 99 wherein the connection 81 passes through a J2 97*b*. The J1 97*a* is also connected to a 3.3-5 volt power supply 88 which connected 89 to pass a signal to but not receive a signal from the level shifter 86 and the encoder 84.

Figure 4:
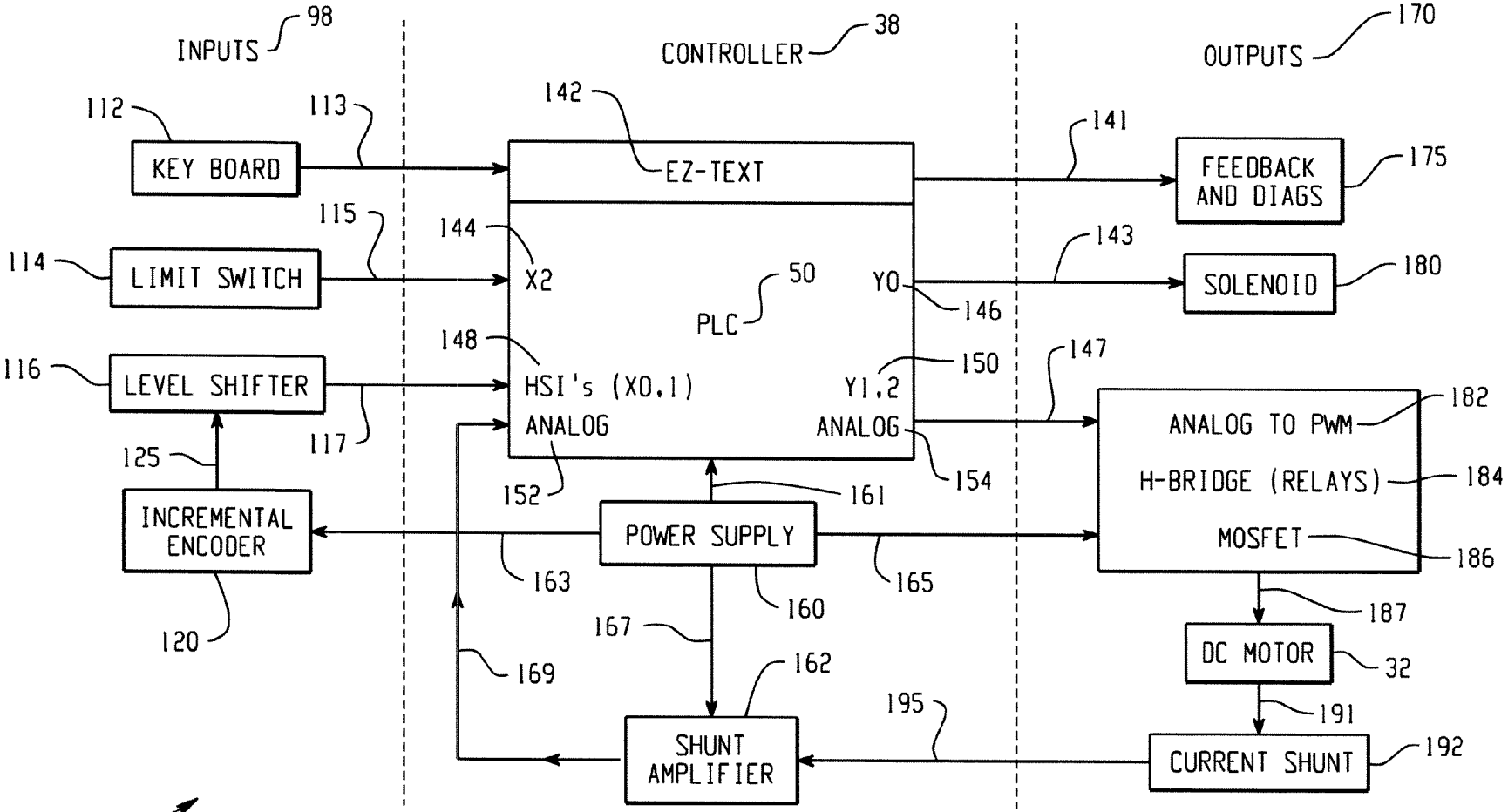
FIG. 4 illustrates the connectivity between the inputs, the controller, and the outputs of the powered drawer.

With reference to FIG. 4, a block diagram 100 of the input 98 to and output from 170 the controller 38 is presented. The input 98 may include, but are not limited to, a keyboard 112 which sends a signal 113 to the input 98, using a device such as, but not limited to, an EZ-Text 142 portion of the controller 38 which passes the signal 141 to an output 170 section of feedback and diagnostics 175. Input 98 may also comprise a limit switch 114 which passes a signal 115 into an X2 144 to the controller 38 component of a PLC 50. Input 98 may also comprise of a level shifter 116 which also passes a signal 117 into a high speed input 148 into the controller 38 component of the PLC 50. The level shifter 116 may itself receive input 125 from an incremental encoder 120.

These inputs to the controller 38 may go to output 170 through a Y0 terminal 146 through connection 143 to a solenoid 180. The inputs may also go to output through a Y1, 2 150 through connection 147 or an analog signal 154 to an output 170 of an analog to PWM 182, to an H-bridge relays 184, or to a MOSFET 186. Each and every output 170 may send a signal 187 to the DC motor 32 which sends a signal 191 to the current shunt 192. The shunt signal 195 is sent to a shunt amplifier 162 which then sends an signal 169 to an analog port 152 of the PLC 50. A common power supply 160 sends power to the PLC 50 by a connection 161, to the Shunt amplifier at 162 through a connection 167, to the incremental encoder 120 through a connection 163 and to the analog to PWM 182, the H-bridge relays 184 and the MOSFET 186 by a common connection 165.

Figure 5A:
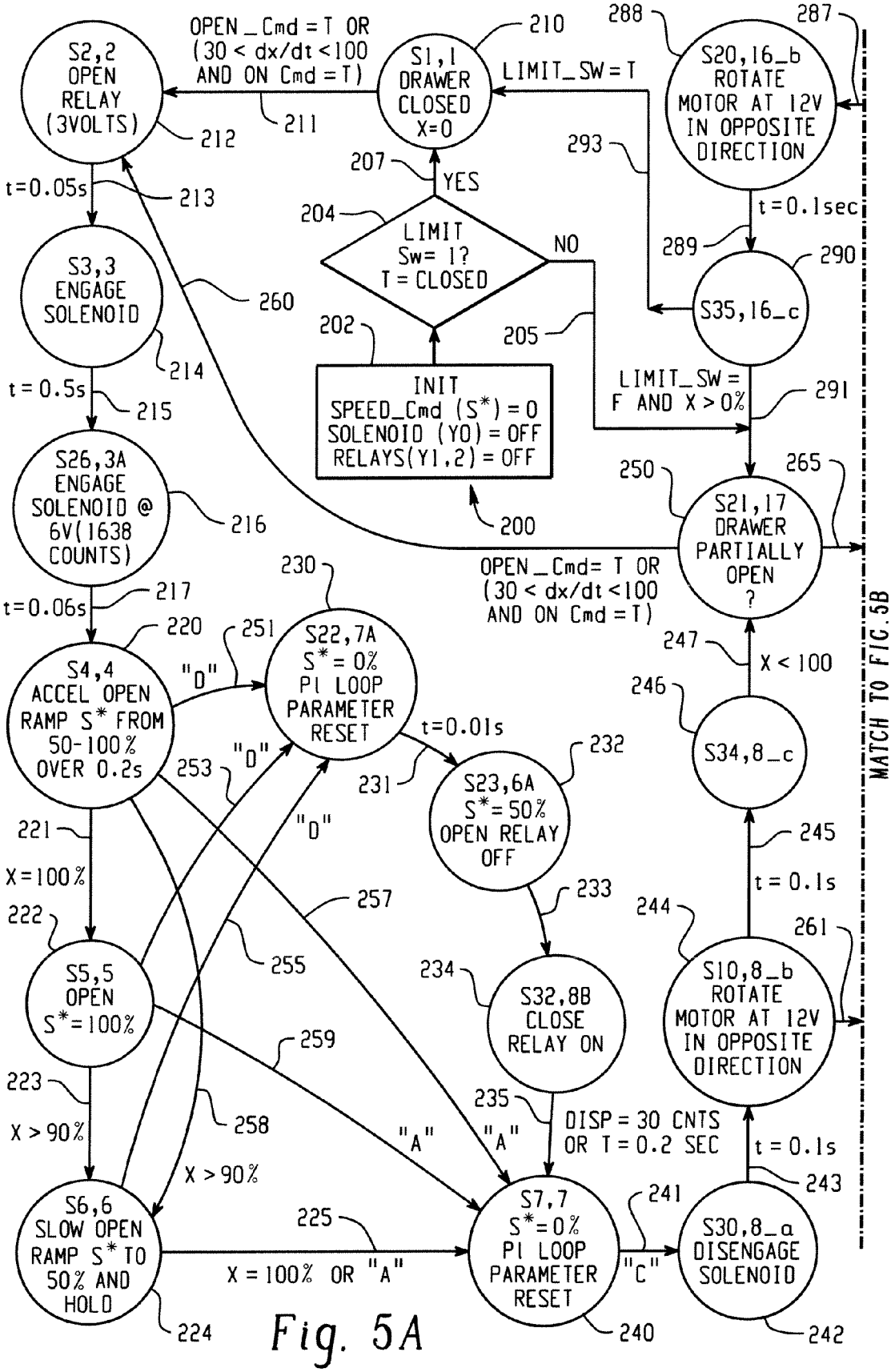
FIG. 5 illustrates the state diagram showing numerous states in which the drawer may reside.
Figure 5B:
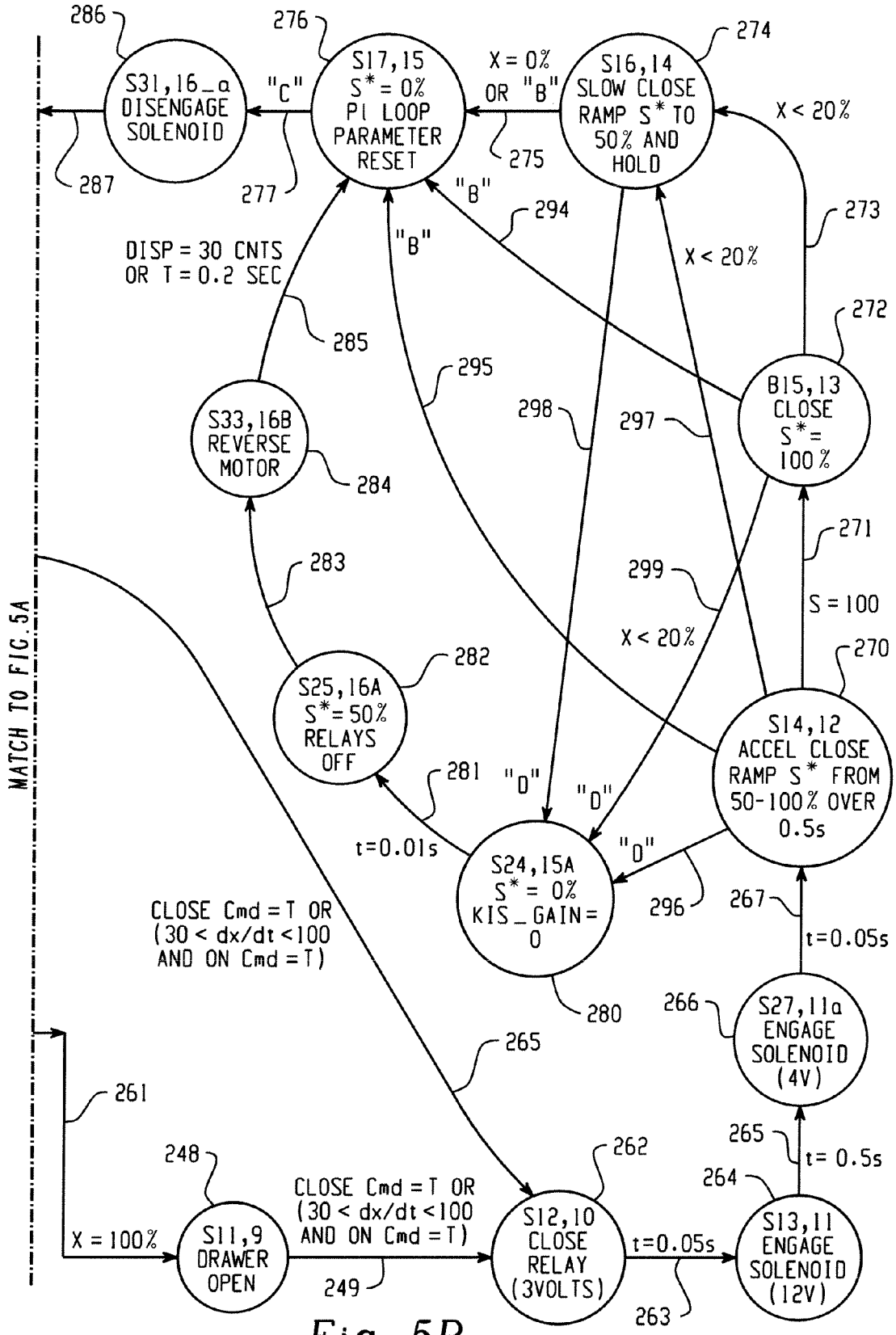

With reference to FIG. 5, a state diagram for the operation of the drawer control mechanism is presented. The diagram contains a number of letter labeled conditions, which are defined here below:

Condition "A"
Open_Cmd=F
or
t>max_open_time
Condition "B"
Close_Cmd=F
or
>max_close_time
or
Limit_Sw=T(Closed)
Condition "C"
I_mot=0
or
t>I_decay_time
Condition "D"
Timed_Overcurrent
Open_Cmd=Open Key
Close_Cmd=Close Key
On_Cmd=On/Off Key
Condition "E"
Open_Cmd=T
or
(30<dx/dt<100
&
On_Cmd=T)
or
Pull_Cmd=T
or
Double Tap=T
Condition "F"
Close Cmd=T
or
(30<dx.dt<100)
&
On_Cmd=T)
or
Push_Cmd=T
or
Double Tap=T
Condition "G"
T=0.4 sec
or
Displacement
=10 Counts The drawer begins at a start state 200 idling with the speed of the drawer at zero, the solenoid off, and the relays off. At this point it can transition to no other state but to move as this would be comparable to turning the system on. An inquiry is made as to the state of the limit switch 202 asking if the switch is closed 204 which is the true condition. If the switch is not closed 205, then the determination is made that the drawer is only partially closed 291. If the limit switch state is true 207, then the drawer is assumed to be closed 210. In such a case, the displacement of the drawer or the amount it is open signified as x, is equal to zero. From this point, a command to open 211 the drawer may be given, in which case the on command will be set equal to true and the derivative of the displacement x relative to time will be greater than zero but less than 100. At this point the relays will be open by 3 volts 212. After a fraction of a second such as 0.05 seconds for example 213, the solenoid is engaged at 12 volts 214. After a brief period of time such as a half a second 215, the solenoid is engaged a 6 volts 216 for a brief time period such as 0.06 seconds 217 wherein the draw opens and accelerates for a time such as 0.2 seconds where the drawer opens from 50% to 100% displacement 220.

From this point, one of four states may be pursued 221, 251, 257, 258. A first state is pursued 258 when the drawer displacement is more than 90% opened 224, then the speed is slowed or decelerated to 50% of the maximum speed. State 221 is pursued when the speed is at maximum 100% speed, this constant speed is maintained 222 until the drawer displacement is more tan 90% open 223 at which time the drawer speed is slowed to 50% of the previous speed 224. In both instance when speed is slowed at 50% of maximum speed 224, when the drawer is 100% open 225 or when the conditions in Condition A are achieved, then the speed is set to zero as the drawer is stopped 240 and the loop parameter is reset. State 240 could also be reached directly from state 222 through route 259 and the conditions in Condition A would also be initiated.

A state 257 may be pursued if the drawer were substantially already opened such as if it were manually pulled open and the system would initiate the parameters presented in Condition A and proceed to the loop parameter reset state 240. State 251 could be pursued where the system would initiate the parameters in Condition D and the loop parameter were reset 230 and the speed is set to zero. This would result in a brief time periods such as 0.01 seconds 231 where the speed was then set to 50% speed and the open relay were turned off 232 after which 233 the close relay would be turned on 234 and the drawer would move for another time such as 0.2 seconds 235 until the speed were set to zero and the loop parameter were reset 240. It could be possible for a number of combination of each of these steps be pursued in a sequence other than the one presented in this description. A path exists from state 222 to state 230 via path 253 or from state 224 to state 230 via path 255. As such, paths 251, 253, or 255 would initiate the parameters in Condition D each arrive at state 230.

Once the drawer is in an open 240 state, then the parameters in Condition C are initiated 241 and the solenoid may be disengaged 242 and after a brief time period such as 0.1 seconds 243 the motor could be rotated in the opposite direction at 12 volts 244. The path chosen now will depend on whether the drawer is partially opened 247 or fully opened 248. If the drawer is partially opened, then after a time such as 0.1 seconds 245 a state S34,8_*c* is achieved 246 such that the drawer is determined to be less than 100% opened 247 which is considered to be partially opened 250. At this point, if the user wishes to attempt to open the drawer again fully, then the entire operation is repeated 260 by setting the open command to true or the speed greater than 30% but less than 100% and the on command is set to true. This proceeds to the original open relay state 212 and the open process begins again. If the user instead chooses to close the partially opened drawer 265, then the close command is set to true, the on command is set to true, and the speed is set to be more than 30% and less than 100%, and the state proceeds to the same state as if the drawer were fully opened and attempting to be closed 262, wherein the close relay is engaged at 3 volts.

If the drawer is at a displacement of x=100% then the system would proceed 261 to the drawer fully opened state 248. Then the system would proceed and the close command is set to true, the on command is set to true 249. Here, the close relay is engaged at 3 volts 262.

The close drawer process begins with the close relay 262 an after a time such as 0.05 seconds 263 the solenoid is engaged at 12 volts 264 and after a time such as 0.5 seconds 265 the solenoid is engaged at 4 volts 266 and then after another time such as 0.5 seconds 267 the closing speed accelerates from 50% to 100% of maximum speed over 0.5 seconds 270.

At this point, one of four paths may be pursued 271, 297, 295 296, each of which ends up going to setting the speed equal to zero and resetting the loop parameter 276. The first path 295 merely goes directly to the speed zero state 276 with the conditions in Condition B being implemented. This would presumably be the path where the drawer were only open a little ways with a small value for displacement x. The second path 271 sets the speed to 100% and proceeds at this speed 272 until the drawer is closed by moving a small displacement path x 294, which would initiate the conditions in Condition B to the loop reset state 276. When displacement x is less than 20% open 273 the drawer undergoes a slowdown of 50% speed 274 until the drawer is closed at a displacement of x=0 at 275. This path would also initiate the conditions in Condition B prior to proceeding to the reset loop state 276. The third path 297 results when B condition occurs and the drawer is less than 20% open initially and proceeds to slow close 274. The fourth path 296 to a point where the speed is set to zero and KIS gain is set to zero 280 and may occur when an obstruction is encountered. This state may also be entered from 274 by route 298 or from state 272 by route 299. In each instance, the conditions in Condition D would be initiated. After a time such as 0.01 seconds 281 the speed increases to 50% of maximum 282 and then 283 the motor reverses 284 followed by a displacement of 30 cnts or a time of 0.2 seconds 285 wherein the parameter reset state is reached 276.

From here 276, the system initiates Condition C and the proceeds 277 to the state of the solenoid being disengaged 286 followed by 287 the rotation of a motor at 12 volts in the opposite direction 288 for a time such as 0.1 seconds 289 until a state 290 is reached 289. At this state the drawer may be determined 293 to be closed and the limit switch set to true and the state is returned 207 to the drawer closed state 210. Alternately, the limit switch may be set to false and the displacement x is greater than zero, 291, meaning that the drawer is still partially of fully opened such that the system returns to the partially opened site 250.

Figure 6:
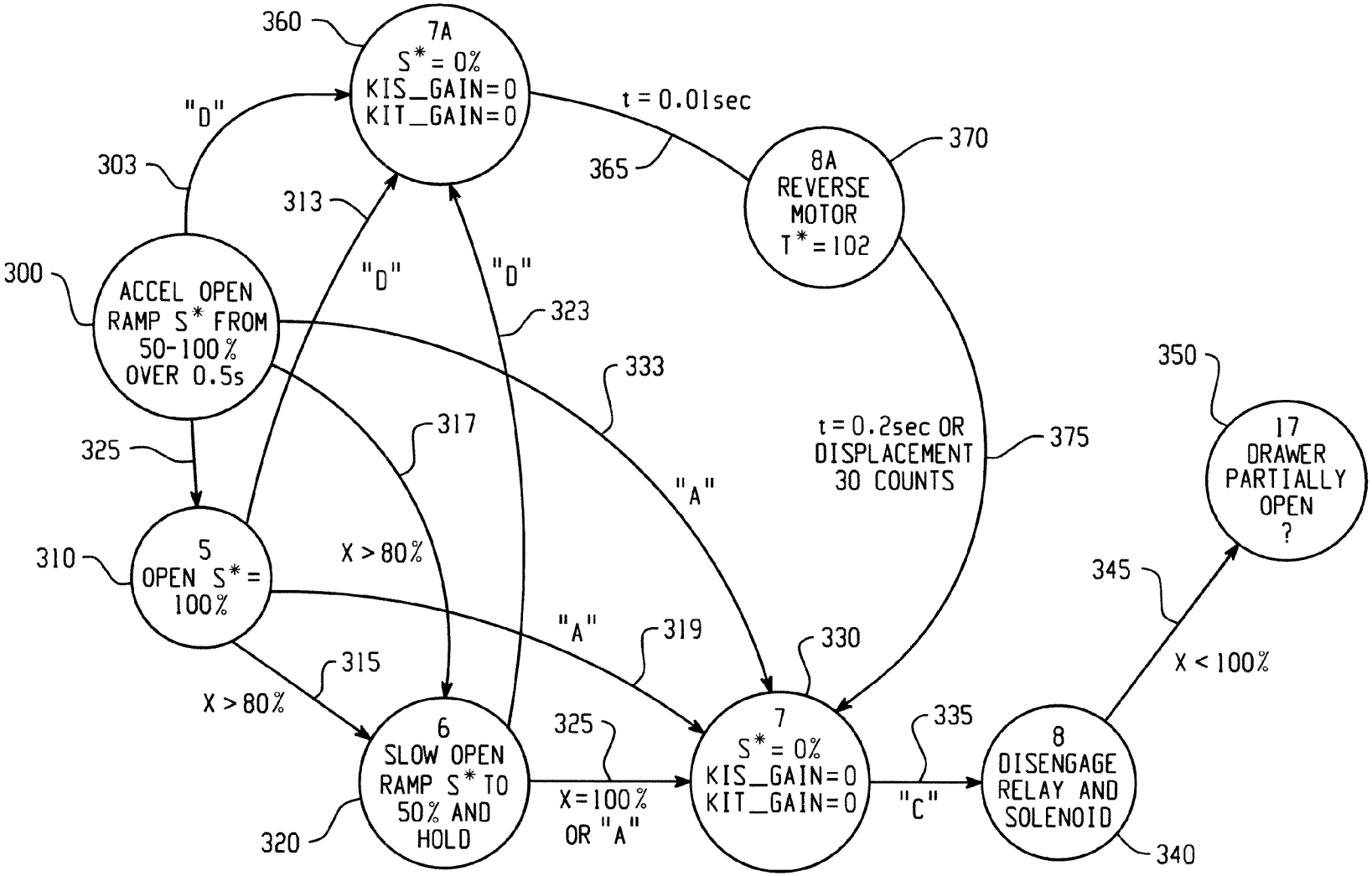
FIG. 6 illustrates a state diagram for an obstruction sensing feature.

With reference to FIG. 6, the states that occur when an obstruction is sensed are illustrated. The drawer is opening such that the speed is between 50% and 100% over a time such as 0.5 seconds 300. Once Condition A will be initiated, the speed will be set to zero and both the KIS gain and KIT gain also set to zero 330. Alternately, when drawer can partially open a displacement greater than 80%, 317. Here the speed will be slowed to 50% and holded so as to not accelerate in order to attempt to slow down the speed. Alternately, the maximum speed can increase 305 to reach maximum 100% speed 310 before sensing while the drawer is greater than 80% open 315. Here the speed will also be slowed to 50% and hold 320 so as to not accelerate in order to attempt to slow down the speed. When the drawer completely opens to 100% displacement or the conditions in Condition A will be initiated 325 then the state speed will be set to zero and both the KIS gain and KIT gain also set to zero 330. Alternately, if the drawer is open 100% 310, the system may, with the conditions in Condition A being initiated, proceed directly 319 to S=0 at 330. It is also possible for the drawer to reverse 303. Here the speed will be set to zero and both the KIS gain and KIT gain also set to zero 360. This state may be arrived at directly from 310 with the condition in Condition D (Overcurrent/Obstruction situation) initiated 313, or directly from state 320 with the conditions in Condition D being initiated 323. After a brief time such as 0.01 seconds 365, the motor will be reversed 370 and after a brief time such as 0.2 seconds 375 the speed, KIS gain, KIT gain set to zero is reached 330. From here, once the conditions in Condition C (Motor stop) are initiated 335 and then both the solenoid and relay are disengaged 340. When the drawer is less than fully 100% opened 345, the drawer is determined to be partially opened 350.

Figure 7:
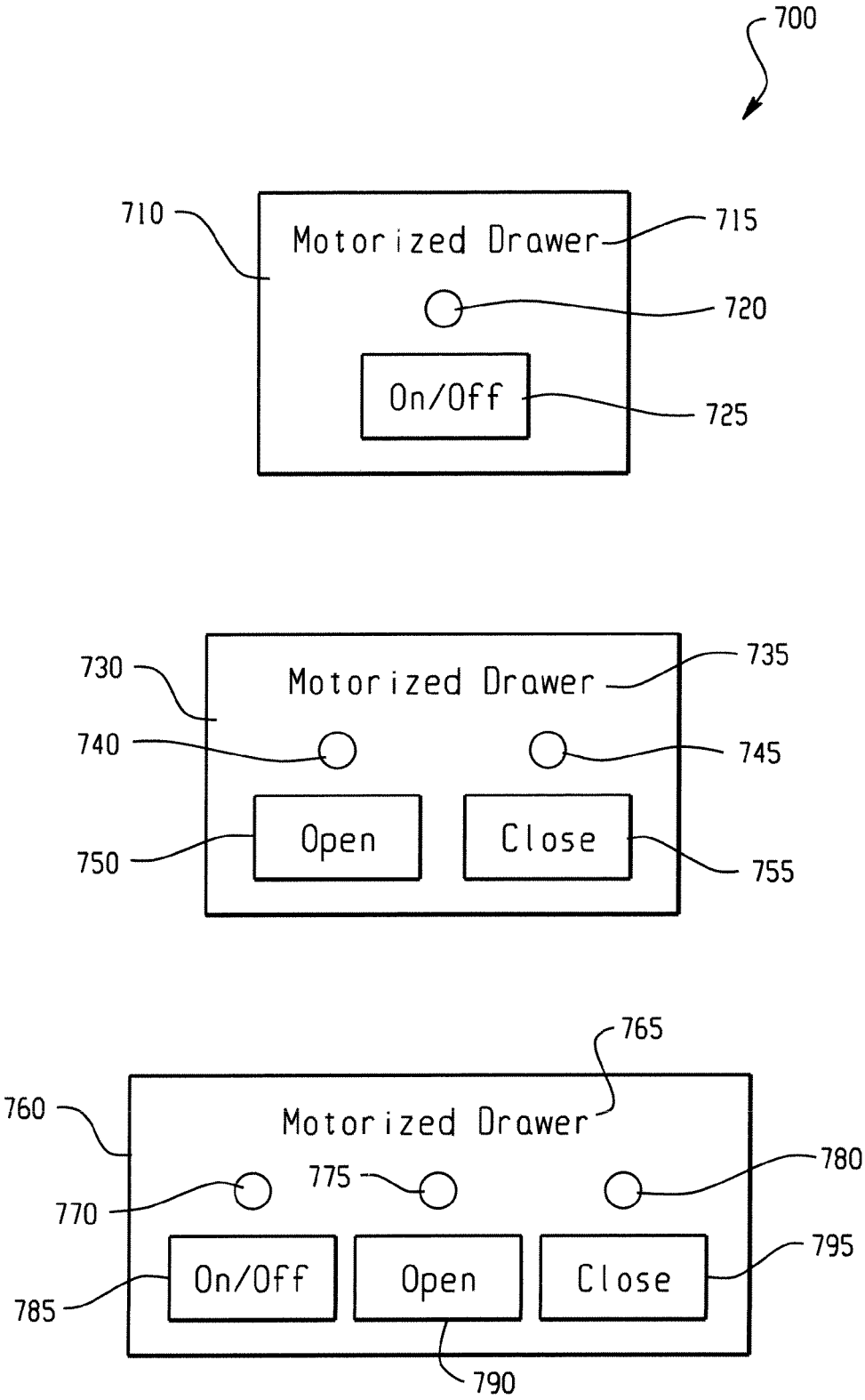
FIG. 7 illustrates alternative switches that may be located on the refrigerator surface or on a remote control device.

With reference to FIG. 7, the various types of user interfaces 98 presented on the surface of an appliance 1 such as on a door 2, 3 or on a remote control are presented. An interface 710 may consist of a label reading "Motorized Drawer" 715 below which is a light or LED 720 that illuminates when an on/off button located below 725 is depressed and the functionality is engaged. Another interface option 730 is a label reading "Motorized Drawer" 735 and two separate lights or LED's below 740, 745 representing whether a separate open 750 or a separate closed 755 button has been pressed. A third alternative 760 is for a label reading "Motorized Drawer" 765 with three lights or LED's 770, 775, 780 below representing separate on off 785 open 790 and close 795 buttons.

In any configuration, the drawer 12 being driven by a driving mechanism reduces the effort required in opening and closing the drawer 12. The automatic close feature ensures that the drawer 12 is fully closed and prevents compressor overrun and loss of energy. The manual override feature enables use of the drawer 12 even during a power outage or when so desired by a user.

The drawer can be opened/closed by pulling/pushing on the drawer handle. The motion and direction is sensed by the A-quad-B encoder, which then engages the solenoid and drives the motor until full open closure or until an obstruction is sensed.

An "On/Off" key can be used to disable the feature . . . green LED is "on" when feature enabled.

Non-volatile memory (NVM) will be used to remember this setting during power outages.

Or . . . "Open" & "Close" keys can be used to open, close and stop the movement of the drawer:

Option 1—Open/Close key press will open/close the drawer until drawer travel is complete, an obstruction is sensed, or a 2nd key press ("Toggle" mode)

Option 2—Open/Close key press & hold will open/close the drawer travel is complete, an obstruction is sensed, or until key is released ("Press & Hold" mode)

Open or Close LED will turn on (solid or flash?) during drawer movement.

In addition, Current sensing (Figures can be added, oscilloscope Charts)

The present allocation will also incorporate over current protection, for use with current more than Delta set limit current of at least 1.5 times than filtered current. Surge protection, with a time such as, but not limited to, 1.5 seconds will also be incorporated. Also, obstruction sensing may be incorporated and is comprised of hard obstruction sensing wherein the drawer stops and stands still at the same position. Obstruction sensing may also consist of soft obstruction sensing, wherein the drawer slides in and out slowly depending the direction guided by the operator.

Additionally, the user Interface may incorporate commands or allow individuals to program their own commands. Such programmable commands may include, but are not limited to: A push key when twice tapped closes the drawer; a pull key when twice tapped opens the drawer; a hold key where holding the drawer will stop it. A "Push to close" keep it pressed, closes the drawer and a release key stops the drawer closing process; and a pull key in which when kept pressed will open the drawer. Released pull key will stop the drawer opening.

In addition, home position sensing may be incorporated such as use of a limit switch or hall sensor sensing. Smart Speed Sensing may also be incorporated for various features such as, sensing speed and auto opens and auto closes; distance and speed are converted to percentage; a check for zero speed to stop movement, senses a speed decay with a timer set to one second. The system will avoid bounce back in the end slows the speed and waits till it stops completely. A maximum open and close timer, will timeout in case drawer is not opened and closed within 6 seconds it will disengage the drive mechanism. Rack and Pinion Uses Optical encoder with Round encoder strip, Another embodiment may use an alternate way of sensing, distance by measuring sensor which is nothing but optical reflective transceiver. The Solenoid control may use an AC or DC solenoid ON/Off i.e. Relay operation or variable voltage control. An unwind motor reverse and then forward may be incorporated in order to insure teeth alignment and to prevent the mechanism from getting jammed. Different embodiments and transmission assemblies such as rack and pinion, crank and lever, and belt & pulley may also be integrated into the present embodiment. These and other improvements may necessitate implementation of different software to control these may be implemented.

Figure 8:
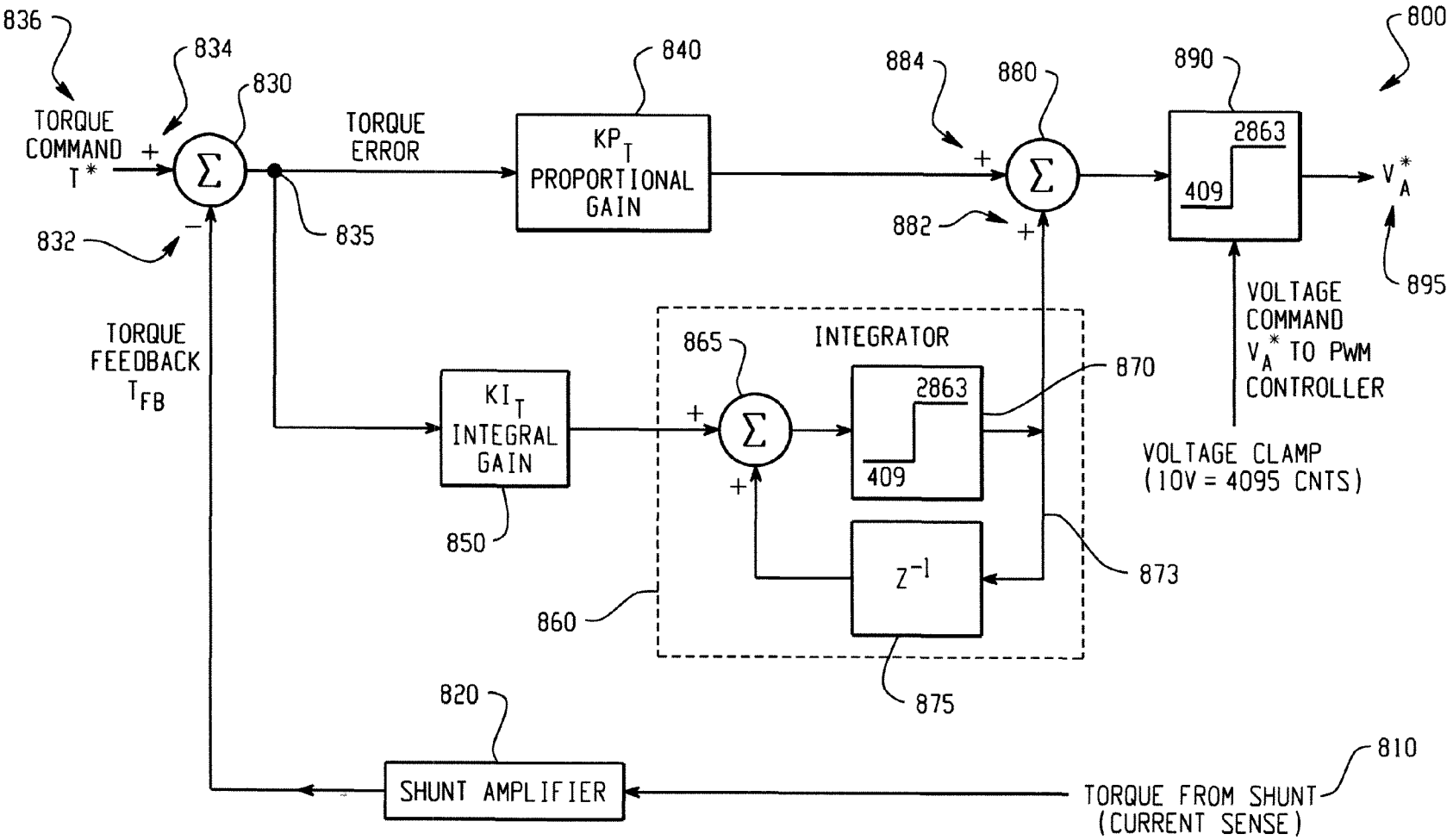
FIG. 8 is a schematic diagram of the torque feedback and control system.

With reference to FIG. 8, the schematic of the P-I Regulator is presented. The signal flow through the circuit 800 begins with a torque from the shunt 810. This signal passes through an amplifier 820 and then into the negative terminal 832 in the form of a torque feedback 830. This signal is combined with a signal 836 passed into the positive terminal 834 in summation 830. Torque error is then considered as the signal coming out is split 835 into a proportional gain 840 and an internal gain 850. The internal gain 850 passes into an integrator 860 through a summation device 865, where an integration 870 is performed over the range such, as but not limited to, from 409 to 2863. The output then is split into a feedback loop 873 where the previous value 875 is derived via $Z^{-1}$, where it is the previous value. The result is then sent to the summation 865 as feedback. The other part of the signal then enters through a positive terminal 882 of a summation 880. This is combined by the summation 890 with the signal from the proportional gain 840 which enters through a second positive terminal 884. The output of this used to perform another range check in the value of 409 to 2863 890 and then proceeds outward 895 to be a voltage VA, the value of which is derived from the formula: VA*(Armature Voltage command)=KpTorqueerror+Ki∫Torqueerror*dt.

For clarification, the output of the PI Torque regulator is a "Voltage command". In the Motorized Drawer application this will be the voltage command to the PWM controller in turn to DC motor. Torque feedback signal will be from Shunt (Current sense) then scaled to units of Torque. $KP_T$ and $KI_T$ values determined somewhat empirically, but generally KI is small (e.g. less than 1). The value of T* is determined by the formula T*=KpSpeed error+Ki∫Speed error*dt, wherein the symbol "∫" may be defined standing for the mathematical operation of integration.

Figure 9:
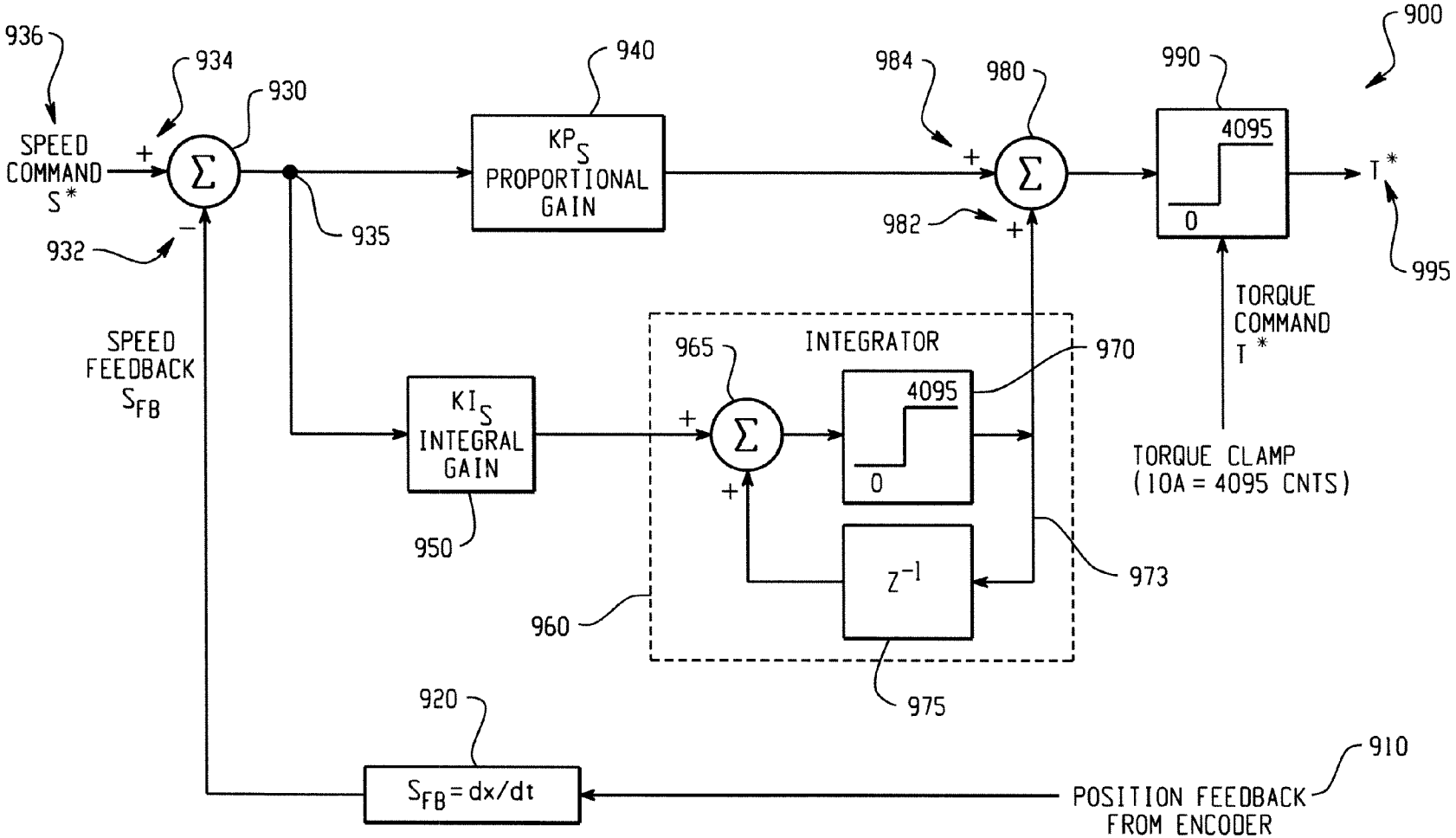
FIG. 9 is a schematic diagram of the speed feedback and control system.

With reference to FIG. 9, a similar process occurs with respect to the speed command. The schematic of the P-I Regulator is presented. The signal flow through the circuit 900 begins with a torque from the position feedback encoder 910. This signal passes through a speed measurement device 920 and then to the negative terminal 932 of summation 930. This signal is combined with a speed command signal 936 which passes into the positive terminal 934 of summation 930. Error is then considered as the signal coming out of the speed feedback is split 935 into a proportional gain 940 and an internal gain 950. The internal gain 950 passes into an integrator 960 through a summation device 965, where a Range check 970 is performed over the range such as, but not limited to, from 0 to 4095, wherein $4095=2^{12}-1$. The output then is split into a feedback loop 973 where the previous value 975 is determined via $Z^{-1}$ and is then sent to the summation 965 as feedback. The other part of the signal then enters through a positive terminal 982 of a summation 980 with the signal from the proportional gain 940 which enters through a second positive terminal 984. The output of this then checked for range 990 and then proceeds outward 995 to be a torque command T*

For clarification, the output of the PI speed regulator is a "Torque command". In the Motorized Drawer application, this will be the Torque command to the Torque regulator. Speed feedback signal will be from Encoder (Position), then scaled to units of Speed. $KP_S$ and $KI_S$ values determined somewhat empirically, but generally KI is small (e.g. less than 1). The torque command T*=KpSpeed error+Ki∫Speed error*dt, wherein the symbol "∫" may be defined as ∫ stands for Integration.

Figure 10:
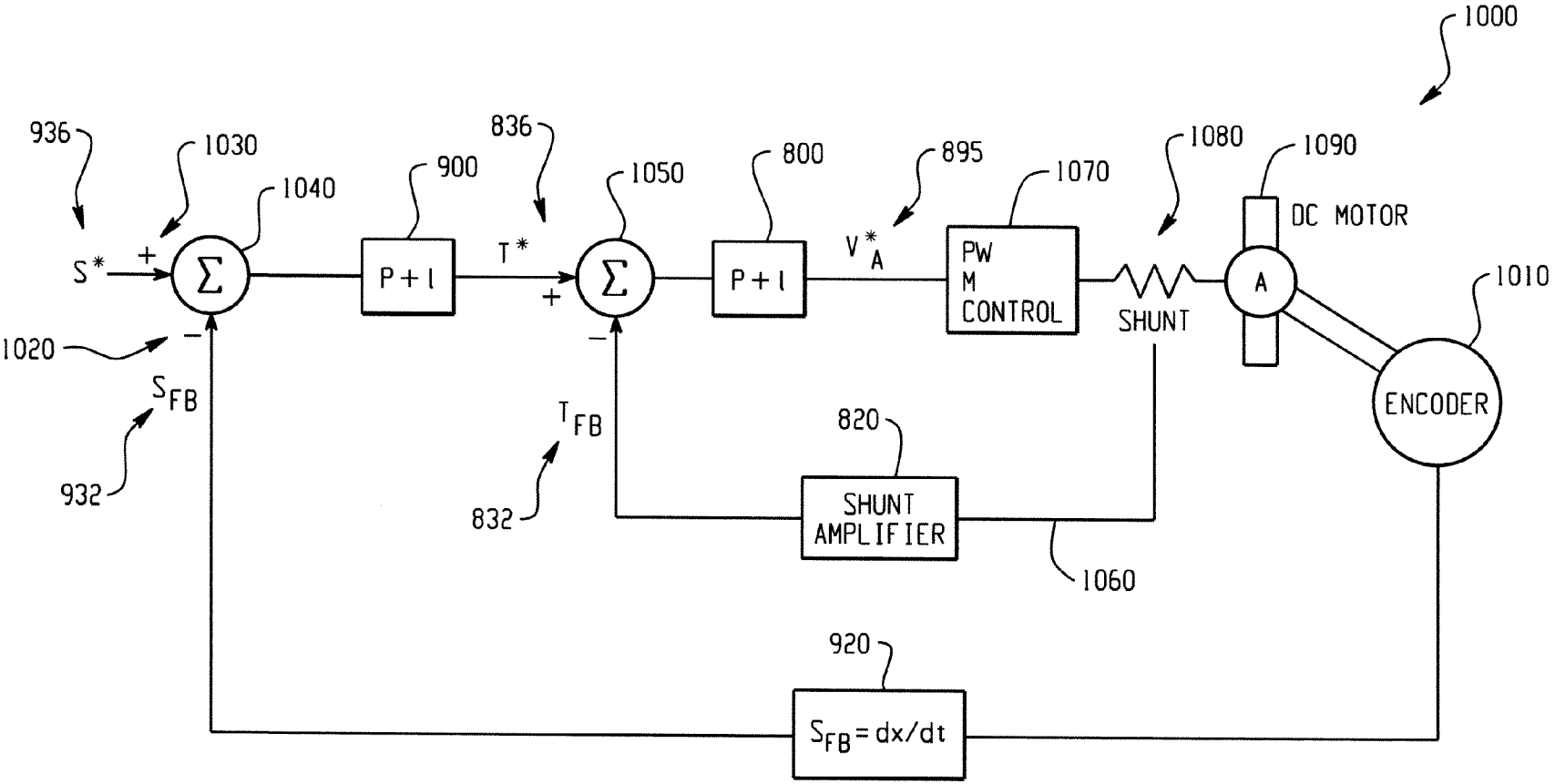
FIG. 10 is a schematic diagram of the integration of the speed and the torque feedback and control systems.

With reference to FIG. 10, the speed-torque control flow diagram 1000 is presented. The Speed-Torque control is used for accurate speed control of motor for different load conditions, Speed regulator P+I (Proportional plus Integral) gains are tuned to compensate for the system's rotating inertia, and the torque regulator P+I gains are tuned to compensate for the motor's inductance. The Encoder 1010 signals the speed as a feedback signal based on the derivative of the displacement of the drawer with respect to time 920 and this output is sent as the speed feedback 932 as an input into a negative terminal 1020 into a summation 1040 with a speed command 936 input into a positive terminal 1030. This combined signal is sent out to the speed regulator 900 which produces a torque command 836 that is combined in a summation 1050 with a feedback from the torque 832. This summation is sent to the torque regulator 800 which outputs a voltage 895 and sends it to the PWM control 1070. The signal out from the PWM control 1070 passes through a shunt resistor 1080. Part of the signal output is used in a feedback loop 1060, where this part of the signal is routed into a shunt amplifier 820 to produce a feedback signal 832. The other part of the signal out to the shunt resistor 1080 passes to a DC motor 1090 which drives the drawer in and out. The motor also passes a signal to the encoder 1010.

The abbreviations in the figure are defined as follows:

S*—Speed Command $S_{FB}$—Speed Feedback

T*—Torque command $T_{FB}$—Torque Feedback $V_A$*—Voltage (Armature) command

The error values are calculated as:

$$\text{Torqueerror}=T^*-\text{Tfb(Torque Feedback)}$$

$$\text{Speederror}=S^*-\text{Sfb(Speed Feedback)}$$

Figure 11:
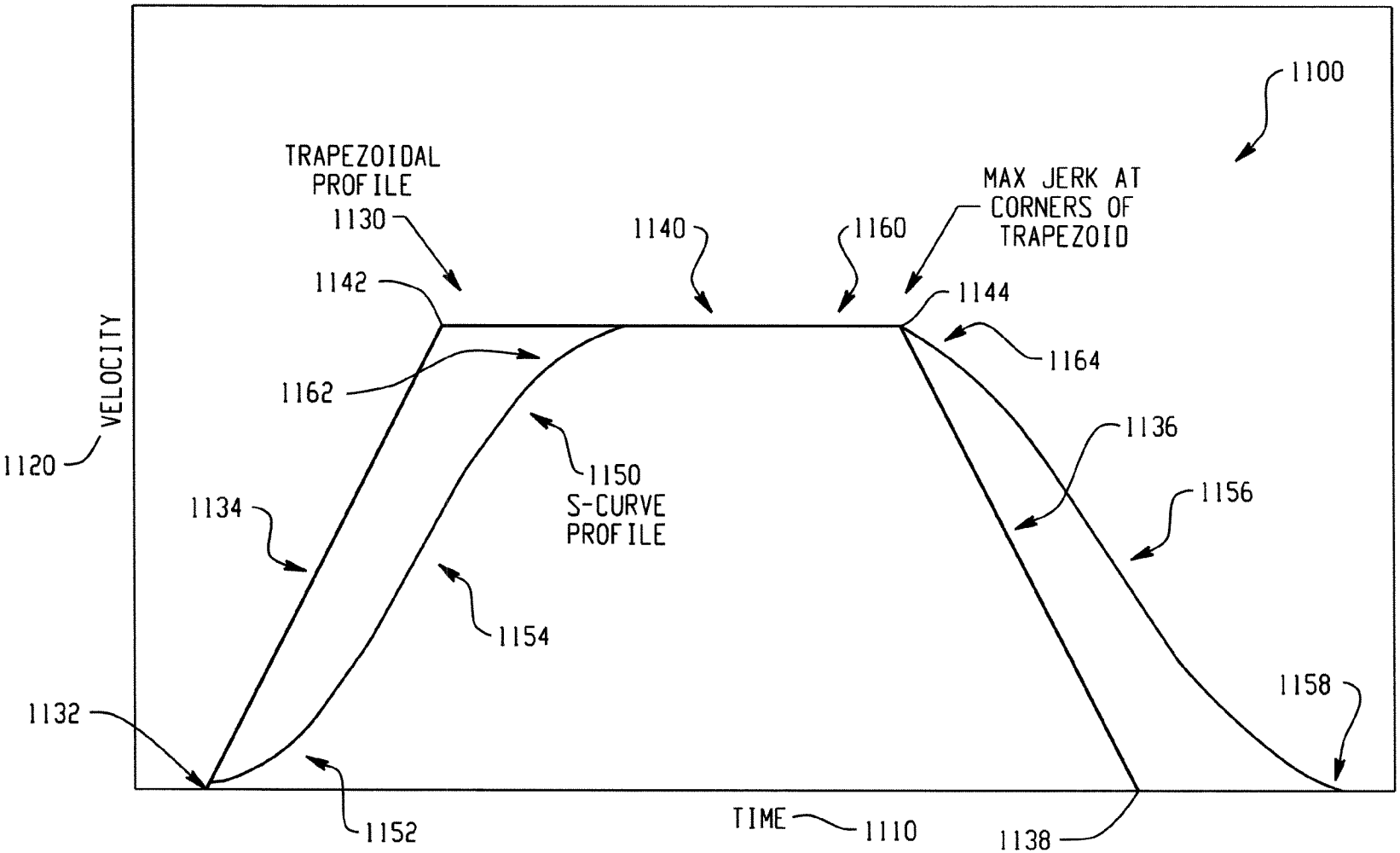
FIG. 11 is a waveform diagram showing a trapezoidal profile and an S-curve profile for the operation of the present application.

With reference to FIG. 11, a waveform demonstrating the functioning of the present embodiment is disclosed. The image 1100 shows a graph with time 1110 on the x-axis and velocity or speed 1120 at which the drawer opens and closes on the y-axis. The graph shows acceleration effect without employing an S-curve 1130 and with an S-curve 1150. Without an S-curve 1130, the acceleration, velocity, and position are loaded, the motor tries to go from a halt of zero speed 1132 and accelerate 1134 to the specified acceleration 1140 instantaneously. When a motor does this, it creates a trapezoidal speed profile. When the motor is ready to stop, it once again goes from acceleration 1140 and decelerates 1136 to a negative acceleration as fast as it can until it is at aero velocity 1138 and then abruptly stops. These abrupt starts and stops create the sharp corners of the trapezoidal profile at the instantaneous acceleration point 1142 and the instantaneous deceleration point 1144. The sharp corners translate to a very high jerk. Jerk is the derivative of acceleration and refers to abrupt changes in acceleration.

The s-curve 1150 represents the present application in which the drawer begins to open slowly 1152 and accelerates 1154, to reach a constant speed 1160, and then slows in acceleration or decelerates 1156 as the drawer speed slows to a stop 1158. Smoothing out the corners of the trapezoid using the s-curve during acceleration 1162 and during deceleration 1164 reduces jerk and prolongs the life of mechanical parts. The speed command S* 936 from FIG. 9 is the input to the motor control algorithm which incorporates the S-curve acceleration and deceleration which creates the shape of the speed profile of a given movement.

Figure 12:
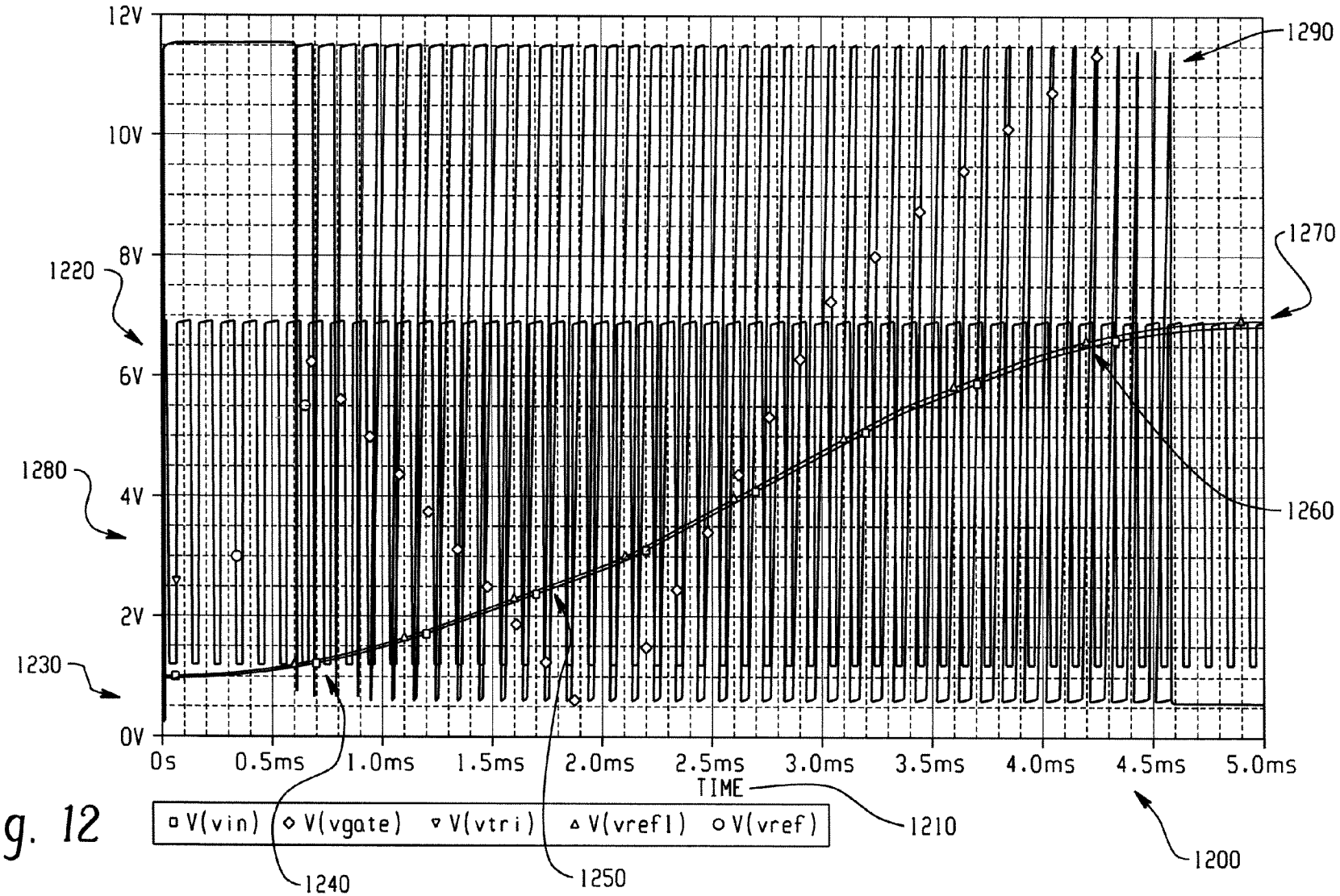
FIG. 12 is a waveform diagram of the S-curve of the present application.

With reference to FIG. 12, a waveform demonstrating the functioning of the present embodiment is disclosed. The waveform 1200 presents time in milliseconds on the x-axis 1210 and voltage on the y-axis 1220. The curve 1230 represents the same feature 1150 as the S-curve in FIG. 11, however this represents the voltage increase as the velocity or speed increases due to acceleration, as the velocity begins slow 1240, increases 1250, accelerates to a constant velocity 1260, and reaches a constant velocity 1270.

The smaller lines 1280 on the waveform that peak at about 7.5 volts represent the modulated PLC signal of the voltage control as the analog signal is converted to PLC voltage in order to operate the prime motor. The smaller lines 1290 that peak at about 11.5 volts represent the saturation voltage of the drive motor. The voltage will vary with the MOSFET duty cycle such that the voltage in may be less than 1 volt for a MOSFET duty cycle of 0%; the voltage may be approximately 4 volts for a MOSFET duty cycle of 50 percent and the voltage may exceed 7 volts for a MOSFET duty cycle of 100 percent.

| | Voltage In: | | |
|---|---|---|---|
| | <1 V | =4 V | >7 V |
| MOSFET duty cycle | 0% | 50% | 100 |

Here the frequency may be equal to 15 KHz or 66 KHZ.

Figure 13:
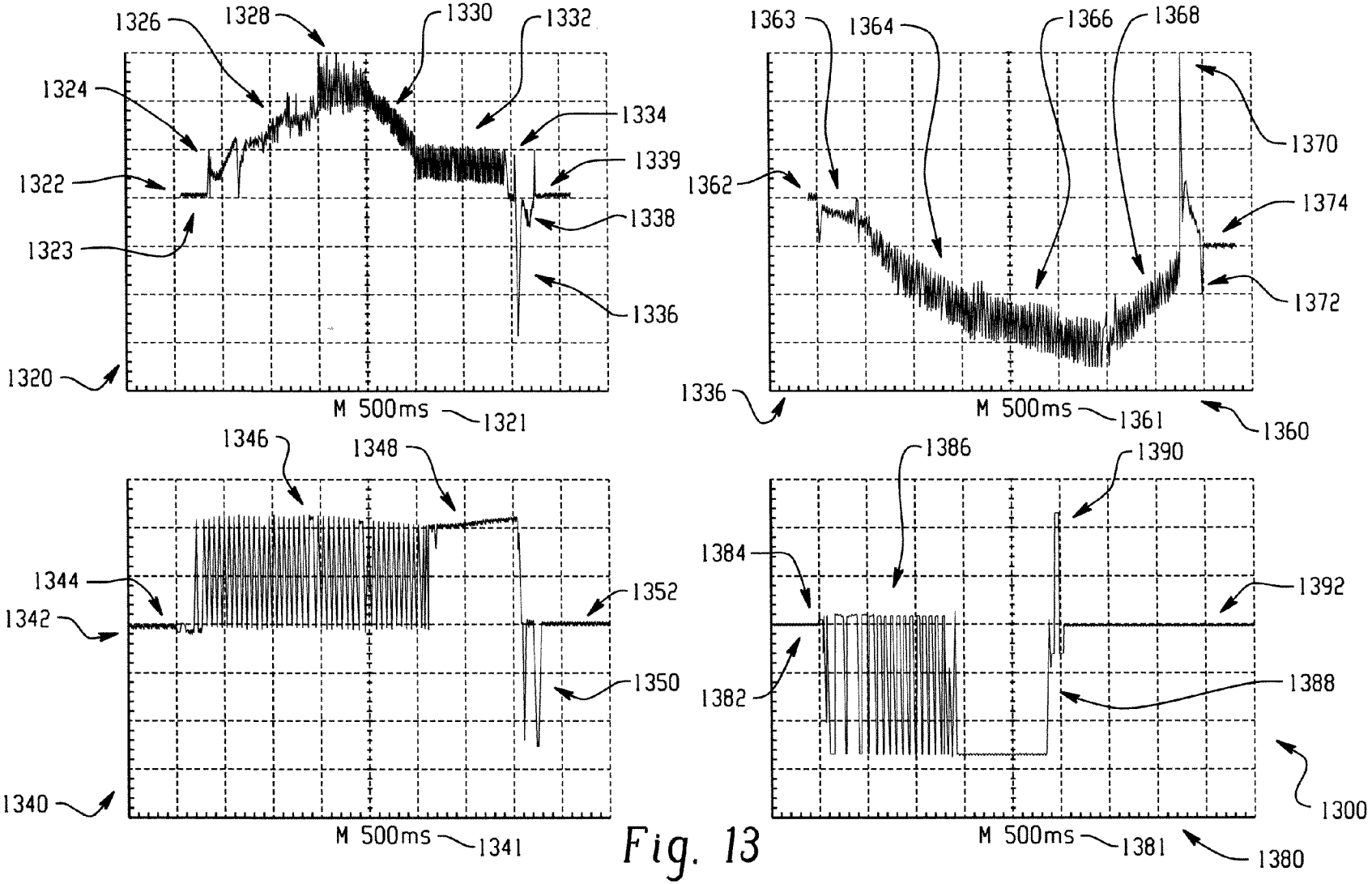
FIG. 13 is a waveform diagram of the motor current for the drawer open and closing normally.

With reference to FIG. 13, a series of waveforms are presented to show the opening 1320, 1340 and closing 1360, 1380 of the drawer device is presented. In all of the presented graphs 20, 40, 60, 80, time in milliseconds is presented on the x-axis 1321, 1341, 1361, 13817 and the voltage is presented on the y-axis 1322 1342, 1362, 1382.

The relationship between time 1321 and motor current in volts 1322 is presented. Voltage initially begins at an initial low level 1323 as the drawer is at rest. Voltage initially spikes 1324 as the drawer begins to open and voltage increases 1326 as the drawer accelerates and levels off 1328 as the drawer reaches a constant speed. The voltage then begins to decrease 1330 as the drawer decelerates 1332 and reaches a constant level at a slower speed 1334. The voltage then drops dramatically as the drawer stops moving 1336 and then climbs again 1338 until the drawer apparatus returns to the voltage of the drawer at rest 1339 which is substantially similar to the voltage level of the drawer at rest.

The drawer opening activity 1320 is paralleled by the PWM voltage across the MOSFET bridge 1340. Time is on the x-axis 1341 and voltage is on the y-axis 1342. Voltage initially is at a low level 1343 as the drawer is at rest. The voltage increases and varies between the higher level and a level substantially similar to the initial level 1346. When the drawer ceases motion and no longer accelerates or decelerates, the voltage variation stops 1348 as the voltage remains at the higher level. Once the drawer stops moving the voltage drops to the lowest level 1350 (Indicating motor reversal) and then returns to the initial level 1352 where the voltage measured when the drawer was initially at rest.

The drawer closing activity 1360 is an inverse of the opening activity 1320. The relationship between time 1361 and motor current in volts 1362 for the drawer closing is presented. Voltage initially begins at an initial low level 1363 as the drawer is at rest. Voltage then decreases 1364 as the drawer begins to close and voltage levels off 1366 as the drawer reaches a constant speed. The voltage then begins to increase 1368 as the drawer speed decelerates and reaches a constant level. The voltage then spikes to 1370 as a sign of motor reversal and then drawer stops and the moving motor has no more work being applied to the drawer since the drawer is no longer moving. The voltage then troughs 1372 and returns to the voltage of the drawer at rest 1374 which is substantially similar to the voltage level of the drawer at rest.

The drawer closing activity of the voltage across the MOSFET 1380 parallels PWM voltage across the MOSFET bridge 1360. Time is on the x-axis 1381 and voltage is on the y-axis 1382. Voltage initially is at a low level 1384 as the drawer is at rest. The voltage begins to vary widely 1386 between the higher level and a level substantially similar to the initial level 1384. When the drawer no longer accelerates or decelerates, the voltage variation stops 1388 as the voltage remains at the lower level. Once the drawer stops moving the voltage spikes 1390 (motor reversal) to its highest level, then returns to the initial level 1392 where the voltage measured when the drawer was initially at rest.

Figure 14:
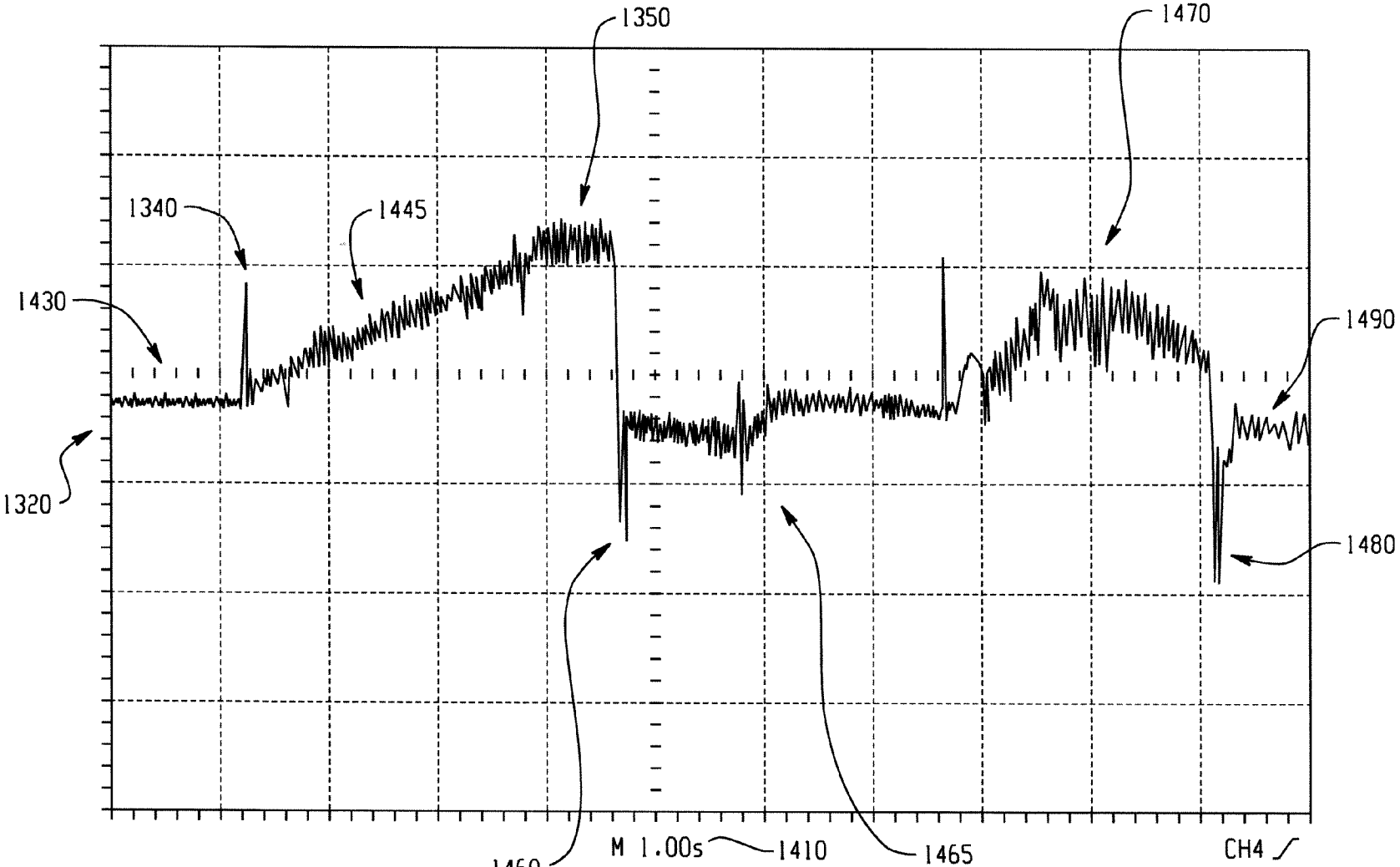
FIG. 14 is a waveform diagram for a motor opening that has encountered an obstruction.

With reference to FIG. 14, a series of waveforms demonstrating the voltage response to the closed drawer in the process of opening as it strikes and obstruction is presented. Time is on the x-axis 1410 and voltage is on the y-axis 1420. The voltage begins at an initial level 1430 when the drawer is at rest. Voltage spikes 1440 as motion begins and increases steadily 1445 as the drawer speed accelerates, reaching a peak and levels off 1450 as the speed reaches a constant velocity. The voltage then drops briefly 1460 as the motor no longer has a load to move and then gradually rises 1465 as the motor attempts to continue moving the drawer forward. This reaches a constant rate 1470 of voltage and then the motor is shut off and the voltage drops 1480 briefly and then returns to the initial level 1490 where the voltage measured when the drawer was initially at rest.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A powered appliance drawer control circuit comprising:

a sensor adapted to receive at least one command signal generated by interaction with an associated user;

a controller in communication with the sensor and adapted to convert the command signal into an instruction; and a driving mechanism including at least one electric motor and a solenoid activator such that the solenoid activator is adapted to operatively position the electric motor in an engaged state with the appliance drawer or a disengaged state with the appliance drawer in response to the instruction and wherein the appliance drawer moves in a selected lateral direction based on the instruction.

2. The control circuit of claim 1, wherein a status sensor is in communication with the controller and detects whether the speed of the opening forward movement of the drawer has changed.

3. The control circuit of claim 1, wherein a status sensor is in communication with the controller and detects whether the speed of the closing rearward movement of the drawer has changed.

4. The control circuit of claim 1, wherein a status sensor is in communication with the controller and detects when the opening forward movement of the drawer has stopped.

5. The control circuit of claim 1, wherein a status sensor is in communication with the controller and detects when the closing rearward movement of the drawer has stopped.

6. The control circuit of claim 1 wherein the solenoid activator is adapted to engage at least one electric motor when the appliance drawer is to be opened or closed.

7. The control circuit of claim 1 wherein the solenoid activator is adapted to disengage at least one electric motor when the drawer has stopped moving open or closed.

8. The control circuit of claim 1 wherein the controller is adapted to change the speed at which the electric motor opens or closes the drawer.

9. The control circuit of claim 1 wherein the command signal transmits data between the controller and the solenoid activator.

10. The control circuit of claim 1, wherein the controller receives a control signal indicating that the drawer has ceased movement and responds with an instruction to the solenoid to disengage the electric motor or the controller receives a control signal indicating that the drawer should begin movement and responds with an instruction to engage the electric motor.

11. The circuit of claim 10 wherein the electric motor is disengaged due to a detected power loss.

12. The circuit of claim 10 wherein the electric motor is disengaged due to the sensor detecting the drawer has encountered an obstruction.

13. The circuit of claim 10 wherein the electric motor is engaged or disengaged due to a user initiated manual over ride.

14. The circuit of claim 10 wherein the electric motor is engaged or disengaged due to the sensor detecting that an outside force has been applied to the drawer.

15. The circuit of claim 10, wherein the control signal that determines the drawer has stopped moving comprises at least one of a hard obstruction sensing and a soft obstruction sensing.

16. The circuit of claim 10, wherein the control signal comprises interpreting a tapping a plurality of times to indicate the drawer should be opened or closed.

17. The circuit of claim 10, wherein the control signal comprises interpreting a hold key to prompt the drawer to stop all movement.

18. The circuit of claim 10, wherein the control signal comprises interpreting a pull of a key to indicate that the drawer should open or close.

19. The circuit of claim 10, wherein the control signal comprises a home position.

20. The circuit of claim 10, wherein the control signal comprises disengaging the electric motor when the speed of the drawer opening or closing reaches zero.

21. The circuit of claim 10, wherein the control signal comprises slowing the speed of the drawer opening when the drawer is substantially opened or substantially closed.

22. The circuit of claim 1, wherein the sensor comprises an optical reflective transceiver.

23. The circuit of claim 1, wherein the drawer may be mounted by at least one of a rack and pinion; crank and lever; and belt and pulley.

24. The control circuit of claim 1, wherein the appliance drawer moves in the selected lateral direction based on the rotation of the electric motor in the engaged state and moves in the selected lateral direction based on the interaction with the associated user in the disengaged state.

25. A system of opening and closing a refrigerator drawer comprising:

receiving an instruction from one of a user input or from a user applied force placed upon the drawer to open a closed drawer or to close an open drawer;

detecting through use of a sensor whether a drawer is currently in an open or a closed position;

sending the instruction to open or close a drawer, along with the current position of the drawer to a controller using a command signal;

signaling that the open drawer is to be closed or the closed drawer is to be opened through use of a command signal emitted from the controller and sent to a solenoid activator which operatively positions an electric motor in selective engagement with the drawer; and activating the electrical motor to open or close flail the drawer.

26. The system of claim 25, wherein the electric motor performing the opening or closing motion pauses when the moving drawer strikes an obstruction.

27. The system of claim 25, wherein the electric motor performing the opening or closing motion may be stopped by a manual over ride of the controller initiated signal.

28. A method of opening and closing a refrigerator drawer comprising:

receiving a user request to open or close a drawer;

detecting a current position of the drawer between an opened position and a closed position;

sending the user request to open or close the drawer, along with the current position of the drawer to a controller using a command signal;

signaling that the open drawer is to be closed or the closed drawer is to be opened through use of a command signal emitted from the controller and sent to a solenoid activator which operatively positions an electric motor in selective engagement with the drawer; and activating the electrical motor to open or close the drawer.

29. A powered appliance drawer control circuit comprising:

a sensor located on an exterior surface of the appliance;

at least one command signal generated after interaction with a user;

a controller adapted to convert the command signal into an instruction;

a solenoid activator connected to a servo and initiated by the instruction; and an appliance drawer which moves in a lateral direction based on the motion of the servo such that the controller may time out and automatically open or close after idling for a period of time.

30. A powered appliance drawer control circuit comprising:

a sensor located on an exterior surface of the appliance;

at least one command signal generated after interaction with a user;

a controller adapted to convert the command signal into an instruction;

a solenoid activator connected to a servo and initiated by the instruction; and an appliance drawer which moves in a lateral direction based on the motion of the servo such that the servo may unwind by reversing and then moving forward to align the jammed teeth of the drawer assembly.

* * * * *